US012685429B2

(12) United States Patent
Dunaway et al.

(10) Patent No.: US 12,685,429 B2
(45) Date of Patent: Jul. 21, 2026

(54) BASKET FOR A DISHWASHING APPLIANCE

(71) Applicant: Haier US Appliance Solutions, Inc., Wilmington, DE (US)

(72) Inventors: Logan Chayse Dunaway, Greenville, IN (US); Aldo Vincent Kremmel, Palmyra, IN (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 18/820,861

(22) Filed: Aug. 30, 2024

(65) Prior Publication Data

US 2026/0060512 A1 Mar. 5, 2026

(51) Int. Cl.
*A47L 15/50* (2006.01)

(52) U.S. Cl.
CPC ..... *A47L 15/502* (2013.01)

(58) Field of Classification Search
CPC . B08B 9/0323; B08B 2209/032; A47L 15/14; A47L 15/4214; A47L 15/4278; A47L 15/50; A47L 15/501; A47L 15/502; A47L 15/503; A47L 15/505; A47L 15/506
See application file for complete search history.

(56) References Cited

U.S. PATENT DOCUMENTS 7,846,269 B2 12/2010 Dunn et al.
8,087,519 B2 * 1/2012 Bramley ..... A47L 15/505 211/41.3
8,522,998 B2 * 9/2013 Crookshanks ..... A47L 15/502 220/826
10,694,922 B1 * 6/2020 Audibert ..... A47L 15/505
10,814,363 B2 * 10/2020 Bowman ..... A47L 15/0089
10,932,647 B1 * 3/2021 Audibert ..... A47L 15/505
11,751,749 B2 * 9/2023 Rowe ..... A47L 15/505 134/137
11,950,744 B2 4/2024 Fawaz et al.
12,075,961 B2 * 9/2024 Fawaz ..... A47L 15/4278
12,185,895 B2 * 1/2025 Lucas ..... A47L 15/507
12,396,616 B2 * 8/2025 Ryan ..... A47L 15/503
2006/0065666 A1 * 3/2006 Dunn ..... A47L 15/505 220/676
2014/0014605 A1 1/2014 Kilgore et al.
2020/0237181 A1 7/2020 Campbell
2021/0001385 A1 1/2021 Bowman
(Continued)

FOREIGN PATENT DOCUMENTS

AU 2020204169 A1 * 1/2021 ..... A47L 15/50
CN 216175120 U 4/2022
(Continued)

*Primary Examiner* — Patrick D Hawn
(74) *Attorney, Agent, or Firm* — Dority & Manning, P.A.

(57) ABSTRACT

A dishwashing appliance defines a vertical, a lateral, and a transverse direction, the dishwashing appliance comprises a wash tub that defines a wash chamber for receipt of articles for washing. The dishwashing appliance includes a manifold disposed within the wash chamber. The manifold defines at least one port. The dishwashing appliance further includes a basket operably positioned within the wash chamber. The basket comprises an article locator that defines an aperture aligned with the at least one port. The article locator aligns with the article to direct fluid from the manifold to the article.

18 Claims, 8 Drawing Sheets

(56) References Cited

U.S. PATENT DOCUMENTS

| | | | | |
|---|---|---|---|---|
| 2021/0045614 | A1* | 2/2021 | Ford | A47L 15/0084 |
| 2024/0324846 | A1* | 10/2024 | Fawaz | A47L 15/14 |
| 2024/0349981 | A1* | 10/2024 | Fawaz | A47L 15/508 |

FOREIGN PATENT DOCUMENTS

| | | | | | |
|---|---|---|---|---|---|
| DE | 202019104788 | U1 * | 9/2019 | ..... | A47L 15/505 |
| DE | 202019104789 | U1 * | 9/2019 | ..... | A47L 15/505 |
| DE | 202020101887 | U1 * | 4/2020 | ..... | A47G 21/184 |
| DE | 202020100262 | U1 * | 4/2021 | ..... | A47L 15/505 |
| DE | 102021104321 | A1 * | 8/2022 | ..... | A47L 15/505 |
| DE | 102022110973 | A1 * | 12/2022 | ..... | A47L 15/505 |
| DE | 102024115932 | A1 * | 1/2025 | ..... | A47L 15/505 |
| EP | 3868260 | A1 * | 8/2021 | ..... | A47L 15/505 |
| EP | 4108153 | A1 * | 12/2022 | ..... | A47L 15/505 |

* cited by examiner

BASKET FOR A DISHWASHING APPLIANCE

FIELD OF THE INVENTION

The present disclosure relates generally to baskets for dishwashing appliances, and more particularly to baskets for supporting utensils to be cleaned within dishwashing appliances.

BACKGROUND OF THE INVENTION

A dishwasher or dishwashing appliance generally includes a tub that defines a wash chamber for receipt of articles for washing. Certain dishwashing appliances also include a rack assembly slidably mounted within the wash chamber. A user can load articles, such as plates, bowls, glasses, cups, or straws, into the rack assembly, and the rack assembly can support such articles within the wash chamber during operation of the dishwashing appliance.

Certain dishwashing appliances also include baskets, or utensil caddies, configured for receipt of articles (e.g., forks, knives, spoons, or other utensils) for washing. The basket is often formed from multiple molded polymer pieces and can be mounted within the wash chamber in various configurations. For example, the basket can be mounted within the rack assembly, on a front of the rack assembly, or on a door of the appliance. Typically, such baskets can be selectively removed from the rack assembly or other portion of the dishwashing appliance on which such baskets are mounted. As a result, a handle is often attached to the baskets so that a user has something to hold when the basket is removed from the dishwashing appliance. These baskets may be oriented such that they hold the utensils in an upright or vertical orientation during washing. Some dishwashers can have a basket that happens to be in a spray path of a spray assembly. However, these dishwashers are missing direct a direct spray path.

Accordingly, a dishwashing appliance that utilizes an improved basket would be useful. More specifically, a basket that with a spray path would be particularly beneficial.

BRIEF DESCRIPTION OF THE INVENTION

The present subject matter provides a dishwashing appliance including a basket. Additional aspects and advantages of the invention will be set forth in part in the following description, may be apparent from the description, or may be learned through practice of the invention.

In accordance with one exemplary embodiment of the present disclosure, a dishwashing appliance defining a vertical, a lateral, and a transverse direction, the dishwashing appliance includes a wash tub that defines a wash chamber for receipt of an article for washing and a manifold disposed within the wash chamber. The manifold defines at least one port. The dishwashing appliance includes a basket operably positioned within the wash chamber. The basket comprises an article locator defining an aperture aligned with the at least one port. The article locator aligns with the article to direct fluid from the manifold to the article.

In accordance with another exemplary embodiment of the present disclosure, a basket for supporting articles within a wash chamber of a dishwashing appliance, the dishwashing appliance comprises a manifold. The basket includes a shell operably engaged with the manifold within the wash chamber and an article locator coupled with the shell. The article locator aligns with a port defined by the manifold such that fluid directed through the manifold is directed through the article locator to an article aligned with the article locator.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
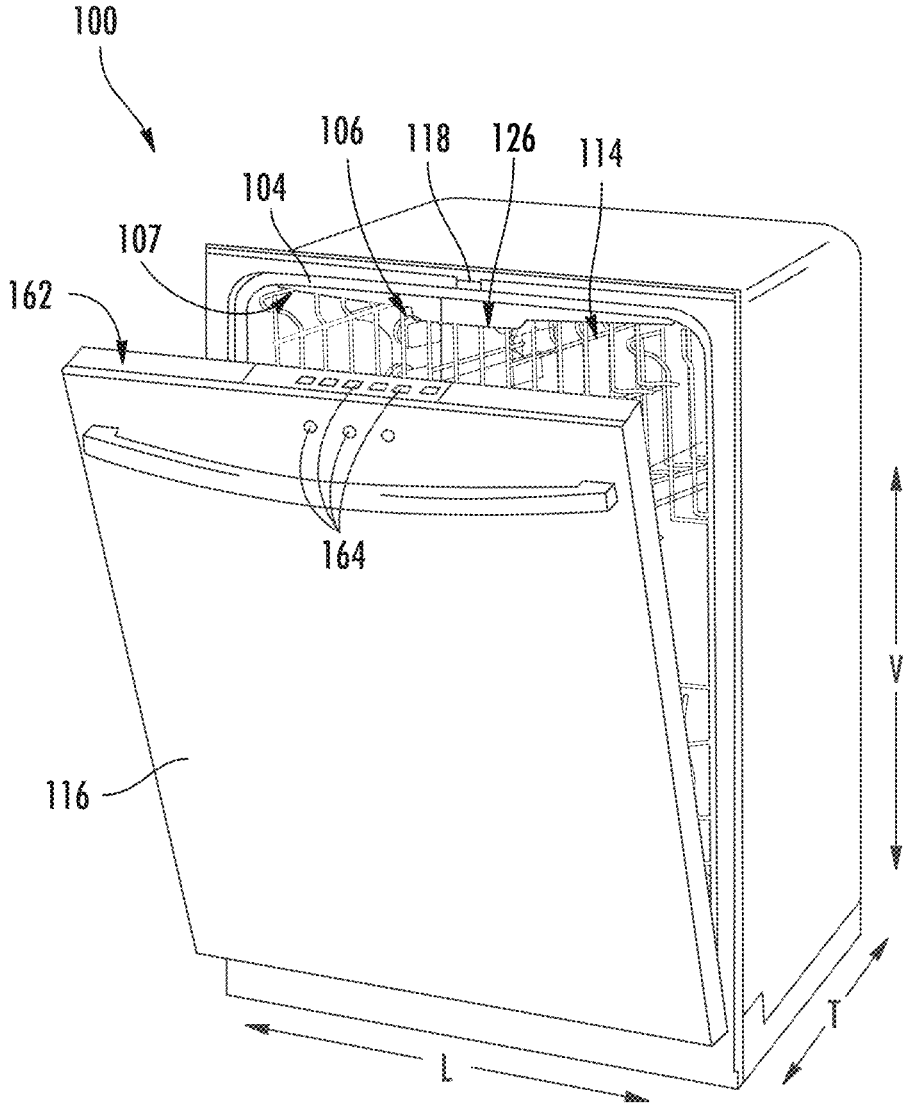
FIG. 1 provides a perspective view of an exemplary embodiment of a dishwashing appliance of the present disclosure with a door in a partially open position.

Repeat use of reference characters in the present specification and drawings is intended to represent the same or analogous features or elements of the present invention.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "article" may refer to, but need not be limited to dishes, pots, pans, silverware, and other cooking utensils and items that can be cleaned in a dishwashing appliance. The term "wash cycle" is intended to refer to one or more periods of time during which a dishwashing appliance operates while containing the articles to be washed and uses a detergent and water, preferably with agitation, to e.g., remove soil particles including food and other undesirable elements from the articles. The term "rinse cycle" is intended to refer to one or more periods of time during which the dishwashing appliance operates to remove residual soil, detergents, and other undesirable elements that were retained by the articles after completion of the wash cycle. The term "drain cycle" is intended to refer to one or more periods of time during which the dishwashing appliance operates to discharge soiled water from the dishwashing appliance. The term "wash fluid" refers to a liquid used for washing and/or rinsing the articles and is typically made up of water that may include other additives such as detergent or other treatments. Furthermore, as used herein, terms of approximation, such as "approximately," "substantially," or "about," refer to being within a ten percent margin of error.

Figure 2:
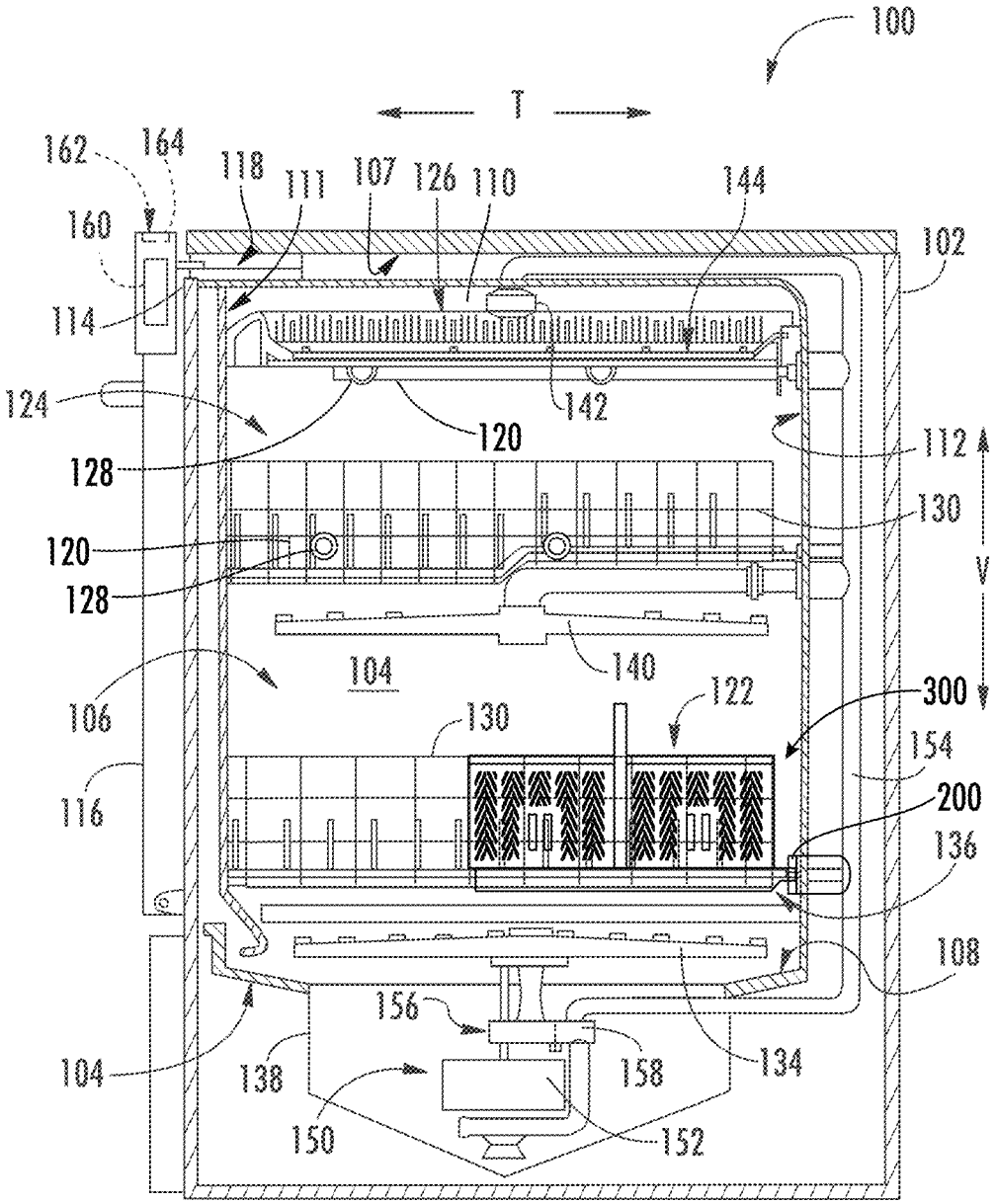
FIG. 2 provides a side, cross-sectional view of the exemplary dishwashing appliance of FIG. 1 according to an example embodiment of the present subject matter.

FIGS. 1 and 2 depict an exemplary domestic dishwasher or dishwashing appliance 100 that may be configured in accordance with aspects of the present disclosure. For the particular embodiment of FIGS. 1 and 2, the dishwasher 100 includes a cabinet 102 (FIG. 2) having a tub 104 therein that defines a wash chamber 106. As shown in FIG. 2, tub 104 extends between a top 107 and a bottom 108 along a vertical direction V, between a pair of side walls 110 along a lateral direction L, and between a front side 111 and a rear side 112 along a transverse direction T. Each of the vertical direction V, lateral direction L, and transverse direction T are mutually perpendicular to one another.

The tub 104 includes a front opening 114 and a door 116 hinged at its bottom for movement between a normally closed vertical position (shown in FIG. 2), wherein the wash chamber 106 is sealed shut for washing operation, and a horizontal open position for loading and unloading of articles from the dishwasher 100. According to exemplary embodiments, dishwasher 100 further includes a door closure mechanism or assembly 118 that is used to lock and unlock door 116 for accessing and sealing wash chamber 106.

As best illustrated in FIG. 2, tub side walls 110 accommodate a plurality of rack assemblies. More specifically, a lower rack assembly 122, a middle rack assembly 124, and an upper rack assembly 126 are stacked along the vertical direction V within wash chamber 106. Each rack assembly 122, 124, 126 is adapted for movement between an extended position (FIG. 6) in which the rack is substantially positioned outside the wash chamber 106, and a retracted position (shown in FIGS. 1 and 2) in which the rack is located inside the wash chamber 106. With respect to middle rack assembly 124 and upper rack assembly 126, this is facilitated, for example, by guide rails 120 which are mounted to tub side walls 110 and rollers 128 mounted onto rack assemblies 124, 126, respectively.

Some or all of the rack assemblies 122, 124, 126 are fabricated into lattice structures including a plurality of wires or elongated members 130 (for clarity of illustration, not all elongated members making up rack assemblies 122, 124, 126 are shown in FIG. 2). In this regard, rack assemblies 122, 124, 126 are generally configured for supporting articles within wash chamber 106 while allowing a flow of wash fluid to reach and impinge on those articles, e.g., during a cleaning or rinsing cycle. According to another exemplary embodiment, a basket may be removably attached to a rack assembly, e.g., lower rack assembly 122, for placement of silverware, utensils, articles, and the like, that are otherwise too small to be accommodated by rack 122.

Dishwasher 100 further includes a plurality of spray assemblies for urging a flow of water or wash fluid onto the articles placed within wash chamber 106. More specifically, as illustrated in FIG. 2, dishwasher 100 includes a lower spray arm assembly 134 disposed in a lower region 136 of wash chamber 106 and above a sump 138 so as to rotate in relatively close proximity to lower rack assembly 122. Similarly, a mid-level spray arm assembly 140 is located in an upper region of wash chamber 106 and may be located below and in close proximity to middle rack assembly 124. In this regard, mid-level spray arm assembly 140 may generally be configured for urging a flow of wash fluid up through middle rack assembly 124 and upper rack assembly 126. Additionally, an upper spray assembly 142 may be located above upper rack assembly 126 along the vertical direction V. In this manner, upper spray assembly 142 may be configured for urging and/or cascading a flow of wash fluid downward over rack assemblies 122, 124, and 126. As further illustrated in FIG. 2, upper rack assembly 126 may further define a top spray assembly 144, which is generally configured for urging a flow of wash fluid substantially upward along the vertical direction V through upper rack assembly 126.

As even further illustrated in FIG. 2, a manifold 200 is generally configured for urging a flow of wash fluid toward a basket 300. The manifold 200 may be located vertically underneath the basket 300 and vertically above lower rack assembly 122 in the lower region 136 of the wash chamber 106 such that the flow of wash fluid is generally directed upward.

The various spray assemblies and manifolds described herein, including the manifold 200, may be part of a fluid distribution system or fluid circulation assembly 150 for circulating water and wash fluid in the tub 104. More specifically, fluid circulation assembly 150 includes a pump 152 for circulating water and wash fluid (e.g., detergent, water, and/or rinse aid) in the tub 104. Pump 152 may be located within sump 138 or within a machinery compartment located below sump 138 of tub 104, as generally recognized in the art. Fluid circulation assembly 150 may include one or more fluid conduits or circulation piping for directing water and/or wash fluid from pump 152 to the various spray assemblies and manifolds. For example, as illustrated in FIG. 2, a primary supply conduit 154 may extend from pump 152, along rear 112 of tub 104 along the vertical direction V to supply wash fluid throughout wash chamber 106.

As illustrated, primary supply conduit 154 is used to supply wash fluid to one or more spray assemblies, e.g., to manifold 200 and upper spray assembly 142. However, it should be appreciated that according to alternative embodiments, any other suitable plumbing configuration may be used to supply wash fluid throughout the various spray manifolds and assemblies described herein. For example, according to another exemplary embodiment, primary supply conduit 154 could be used to provide wash fluid to mid-level spray arm assembly 140 and a dedicated secondary supply conduit (not shown) could be utilized to provide wash fluid to upper spray assembly 142. Other plumbing configurations may be used for providing wash fluid to the various spray devices and manifolds at any location within dishwasher appliance 100.

Each spray arm assembly 134, 140, 142, top spray assembly 144, manifold 200, or other spray device may include an arrangement of discharge ports or orifices for directing wash fluid received from pump 152 onto dishes or other articles located in wash chamber 106. The arrangement of the discharge ports, also referred to as ports 206, jets, apertures, or orifices, may provide a rotational force by virtue of wash fluid flowing through the discharge ports. Alternatively, spray arm assemblies 134, 140, 142, and manifold 200 may be motor-driven, or may operate using any other suitable drive mechanism. Spray manifolds and assemblies may also be stationary. The resultant movement of the spray arm assemblies 134, 140, 142, the manifold 200, and the spray from other manifolds, that may be fixed, provides coverage of dishes and other dishwasher contents with a washing spray. Other configurations of spray assemblies may be used as well. For example, dishwasher 100 may have additional spray assemblies for cleaning silverware from above, for scouring casserole dishes, for spraying pots and pans, for cleaning bottles, etc. One skilled in the art will appreciate that the embodiments discussed herein are used for the purpose of explanation only, and are not limitations of the present subject matter.

In operation, pump 152 draws wash fluid in from sump 138 and pumps it to a diverter assembly 156, e.g., which is positioned within sump 138 of dishwashing appliance. Diverter assembly 156 may include a diverter disk (not shown) disposed within a diverter chamber 158 for selectively distributing the wash fluid to the spray arm assemblies 134, 140, 142, manifold 200, and/or other spray manifolds or devices. For example, the diverter disk may have a plurality of apertures that are configured to align with one or more outlet ports (not shown) at the top of diverter chamber 158. In this manner, the diverter disk may be selectively rotated to provide wash fluid to the desired spray device.

According to an exemplary embodiment, diverter assembly 156 is configured for selectively distributing the flow of wash fluid from pump 152 to various fluid supply conduits, only some of which are illustrated in FIG. 2 for clarity. More specifically, diverter assembly 156 may include five outlet ports (not shown) for supplying wash fluid to the manifold 200, a first conduit for rotating lower spray arm assembly 134, a second conduit for rotating mid-level spray arm assembly 140, a third conduit for spraying upper spray assembly 142, and a fourth conduit for spraying an auxiliary rack such as the silverware rack.

The dishwasher 100 is further equipped with a controller 160 to regulate operation of the dishwasher 100. The controller 160 may include one or more memory devices and one or more microprocessors, such as general or special purpose microprocessors operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 160 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

The controller 160 may be positioned in a variety of locations throughout dishwasher 100. In the illustrated embodiment, the controller 160 may be located within a control panel area 162 of door 116 as shown in FIGS. 1 and 2. In such an embodiment, input/output ("I/O") signals may be routed between the control system and various operational components of dishwasher 100 along wiring harnesses that may be routed through the bottom of door 116. Typically, the controller 160 includes a user interface panel/controls 164 through which a user may select various operational features and modes and monitor progress of the dishwasher 100. In one embodiment, the user interface 164 may represent a general purpose I/O ("GPIO") device or functional block. In one embodiment, the user interface 164 may include input components, such as one or more of a variety of electrical, mechanical or electro-mechanical input devices including rotary dials, push buttons, and touch pads. The user interface 164 may include a display component, such as a digital or analog display device designed to provide operational feedback to a user. The user interface 164 may be in communication with the controller 160 via one or more signal lines or shared communication busses.

It should be appreciated that the invention is not limited to any particular style, model, or configuration of dishwasher 100. The exemplary embodiment depicted in FIGS. 1 and 2 is for illustrative purposes only. For example, different locations may be provided for user interface 164, different configurations may be provided for rack assemblies 122, 124, 126, different spray arm assemblies 134, 140, 142, manifold 200, and other spray manifold configurations may be used, and other differences may be applied while remaining within the scope of the present subject matter.

Figure 6:
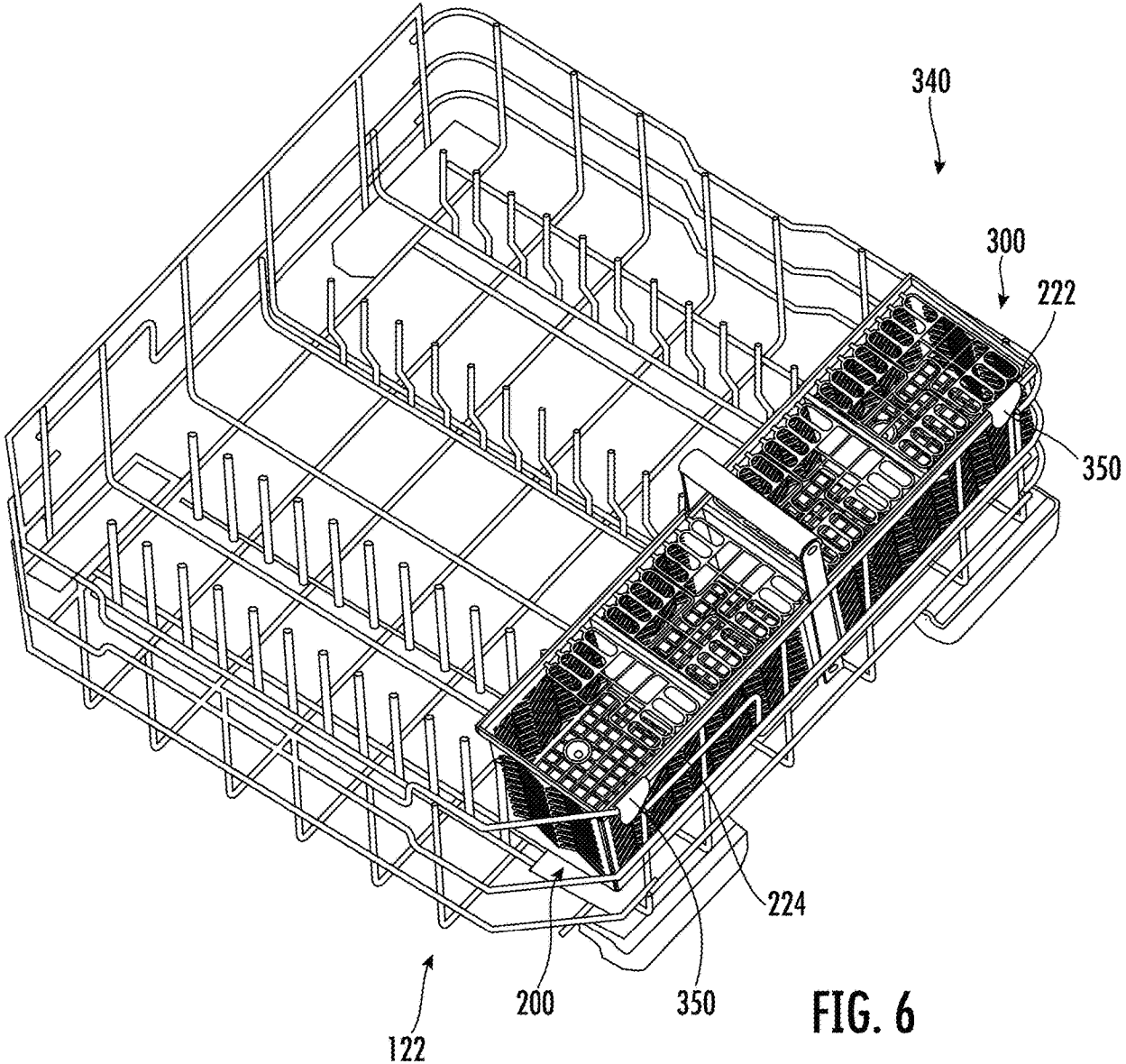
FIG. 6 provides a top perspective view of the exemplary basket of FIG. 3 engaged with the exemplary lower rack of FIG. 5 according to an example embodiment of the present subject matter.
Figure 7:
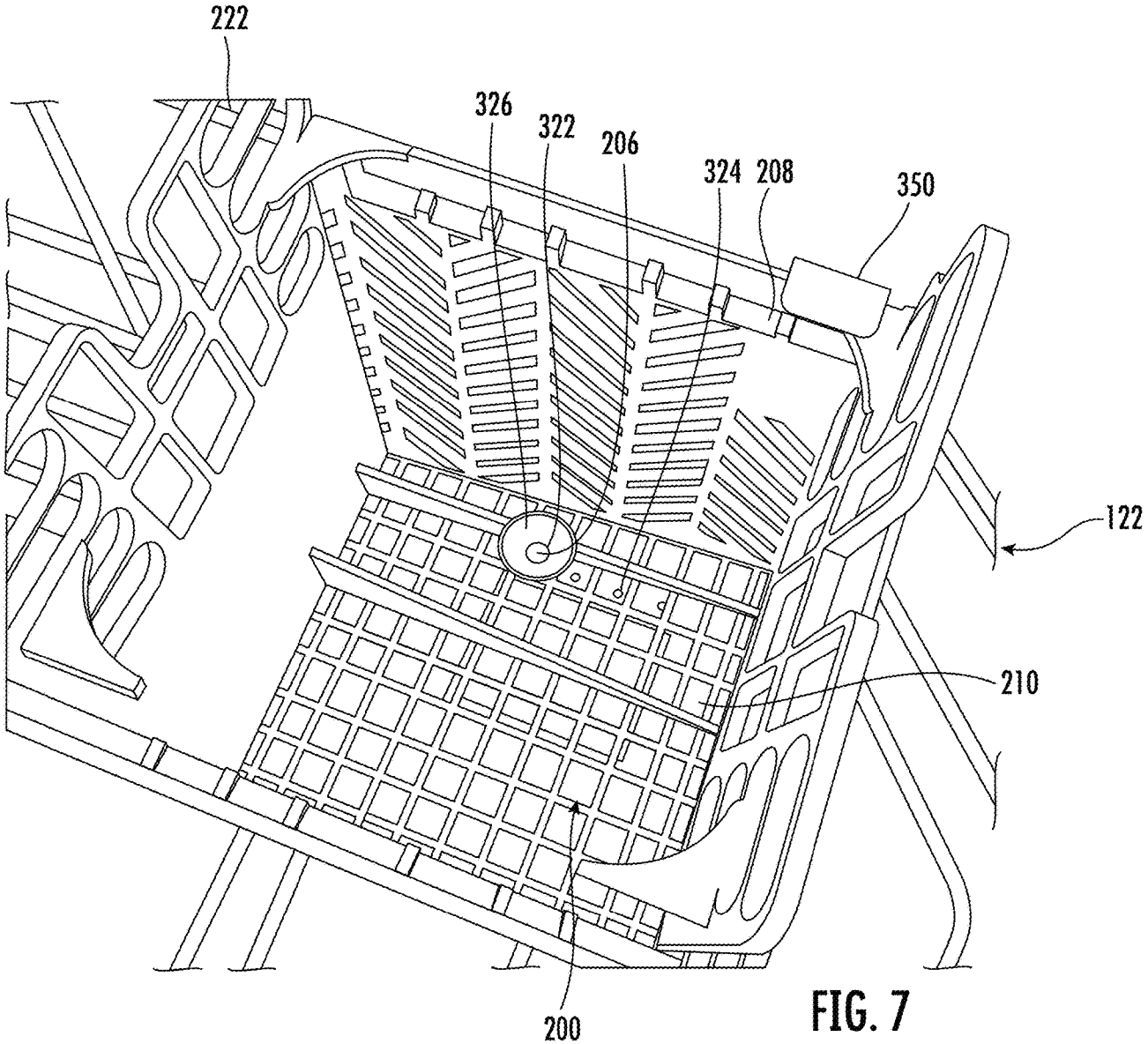
FIG. 7 provides a zoomed-in top perspective view of the exemplary basket engaged with the exemplary lower rack of FIG. 6 according to an example embodiment of the present subject matter.
Figure 8:
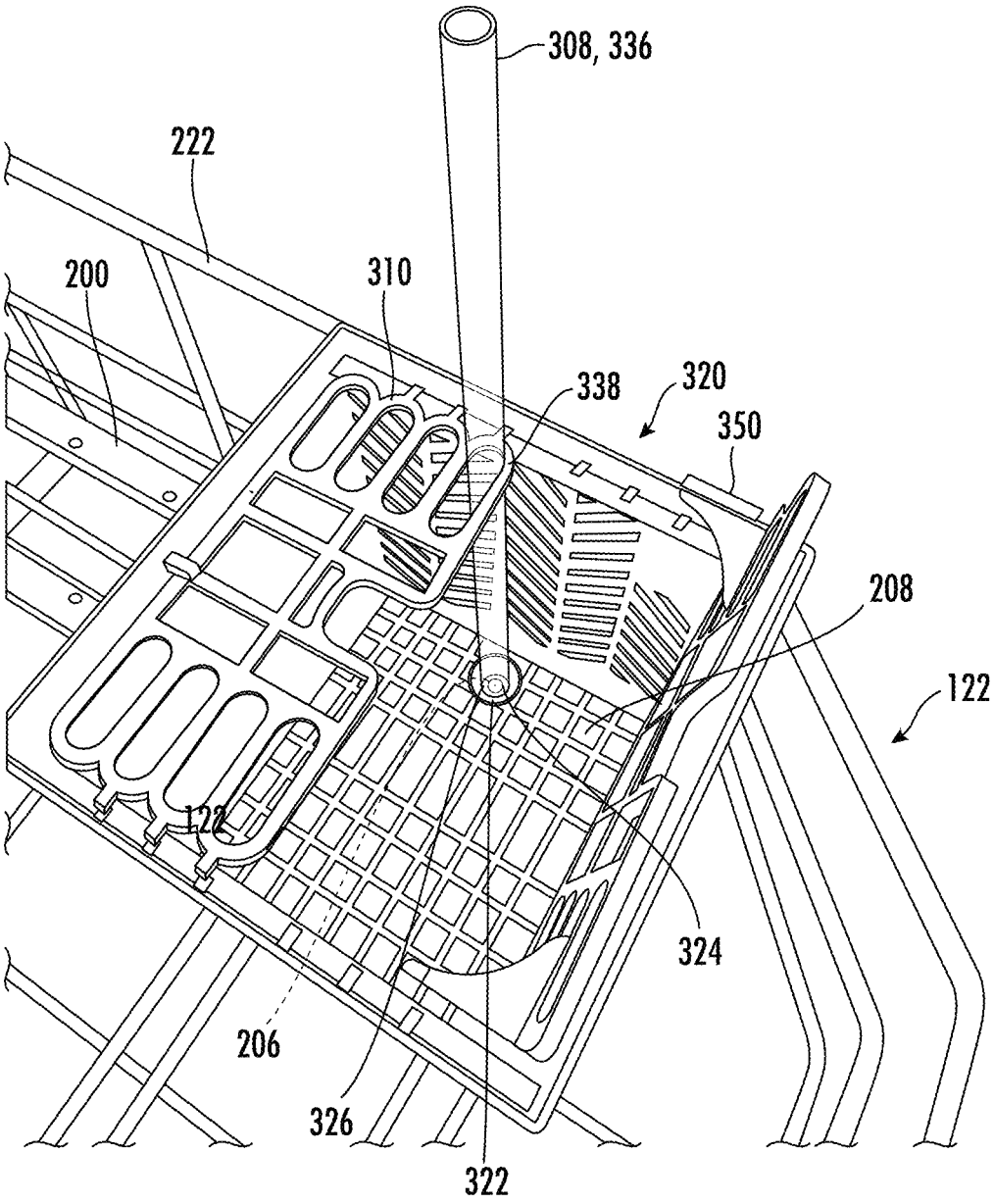
FIG. 8 provides a top perspective view of the exemplary basket engaged with the exemplary lower rack of FIG. 7 featuring an article according to an example embodiment of the present subject matter.

Referring now generally to FIGS. 2 through 8, a basket 300 will be described according to an example embodiment of the present subject matter. As described in more detail below, the basket 300 is configured to support an article as shown in FIG. 8. The lower rack assembly 122 may be used as shown in FIG. 2 for supporting the basket 300. In other words, the basket 300 is operably, generally connected with the lower rack assembly 122. The lower rack assembly 122 may be used as shown in FIGS. 2, and 5 through 8 for supporting the manifold 200. In other words, the manifold 200 is generally connected with the lower rack assembly 122. The basket 300, as illustrated, may be specifically supported by the manifold 200. Further, the basket 300 may be specifically coupled with the manifold 200, as illustrated in the examples of FIGS. 2 through 8.

In addition, as shown in the exemplary embodiment illustrated in FIG. 2, tub 104 of dishwasher 100 may define lower guide rails. In this manner, when door 116 is in the open position such that it extends substantially within a horizontal plane, the lower rack assembly 122 may slide out of wash chamber 106 along the transverse direction T and rest on door 116 for loading and unloading dishes as well as the basket 300 and utensils from the basket 300. Although the manifold 200 and the basket 300 are illustrated as being supported by lower rack assembly 122, it should be appreciated that the manifold 200 and the basket 300 may be supported with any suitable dishwasher rack assembly e.g., the middle rack assembly 124, or the upper rack assembly 126. Additionally, or alternatively, the manifold 200 and the basket 300 may be supported by any suitable surface within the wash chamber 106 (e.g., the tub side wall 110, the door 116, etc.).

Figure 3:
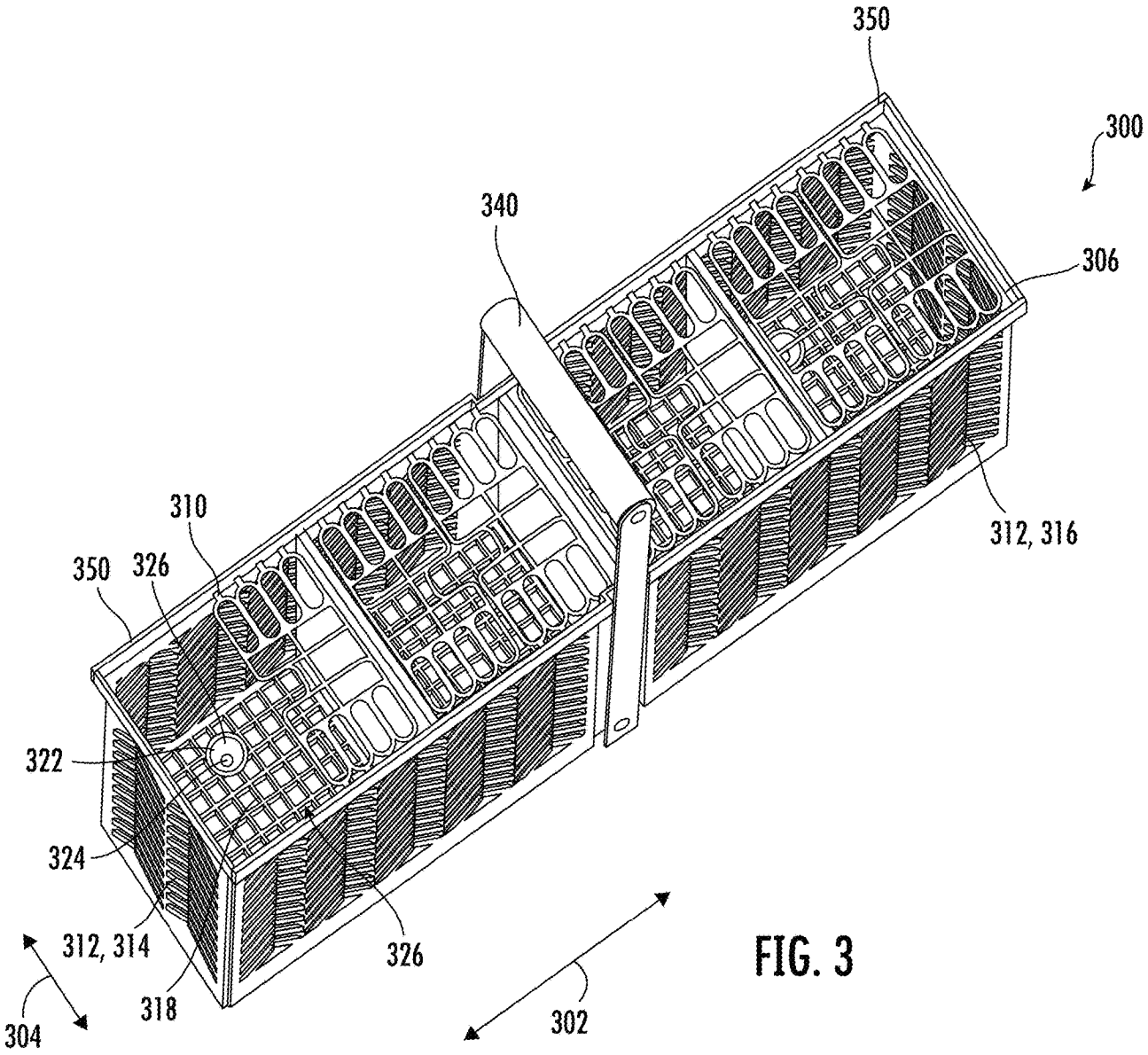
FIG. 3 provides a top perspective view of a basket for the exemplary dishwashing appliance of FIG. 1 according to an example embodiment of the present subject matter.
Figure 4:
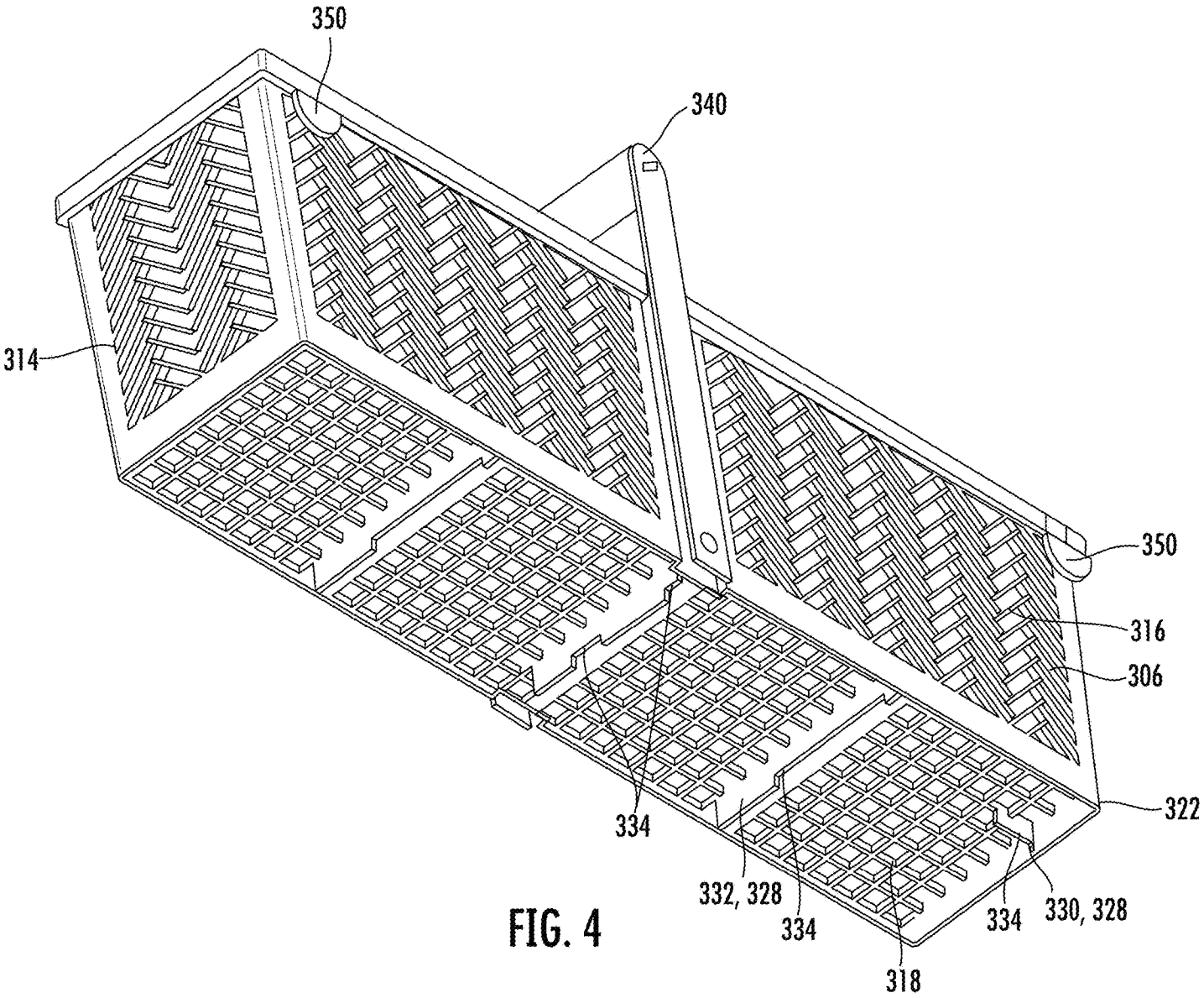
FIG. 4 provides a bottom perspective view of the exemplary basket of FIG. 3 according to an example embodiment of the present subject matter.

As best shown in FIG. 3, lower rack assembly 122 may support the manifold 200 and the basket 300. In this regard, the manifold 200, and as a result the basket 300, may be positioned on a lateral side of the lower rack assembly 122. Additionally, or alternatively, the manifold 200 and the basket 300 may be positioned on a transverse side of the lower rack assembly 122. Moreover, as described below, the manifold 200 and the basket 300 are designed to be interchangeably used on either the left side, the right side, the front side, or the rear side of lower rack assembly 122. In this manner, the same basket 300 may be placed at the manifold 200 that is positioned at the left, the right side, the front side, and the rear side, thereby reducing manufacturing costs and complexity. Notably, when the basket 300 is placed onto the lower rack assembly 122, the manifold and the basket 300 shares a coordinate system with the dishwasher 100. Therefore, the manifold 200 and the basket 300 will be described herein as sharing the vertical direction V, the lateral direction L, and the transverse direction T with dishwasher 100.

With additional reference to FIG. 3, the basket 300 may be generally elongate, prismatic, rectangular, or a combination thereof. Therefore, the basket 300 may have a major direction of extent 302 and a minor direction of extent 304. The major direction of extent 302 is generally orthogonal with the minor direction of extent 304. As described above, the basket 300 may be placed adjacent to a lateral or transverse side of the lower rack assembly 122, or another conceivable location within the wash chamber 106. Further, the basket 300 may be placed with the major direction of extent 302 oriented along the transverse direction T or the lateral direction L. Even further, the basket 300 may be placed with the minor direction of extent 304 along the vertical direction V (not shown). Alternatively, the basket 300 may be placed with the major direction of extent 302 along the vertical direction V (not shown). As illustrated, the basket 300 is placed onto the lower rack assembly 122 such that the major direction of extent is along the transverse direction T and the minor direction of extent is along the lateral direction L.

Furthermore, the basket 300 includes a clip 350 coupled with the shell 306. Additionally, or alternatively, the clip 350 may be unitarily formed with the shell 306. The clip 350 is configured to at least partially receive the lower rack assembly 122. The clip 350 of the basket 300 may receive a lower rack side rail 220. For example, the clip 350 may receive a transverse side rail 222 of the lower rack assembly 122. Additionally, or alternatively, the clip 350 may receive a lateral side rail 224 of the lower rack assembly 122. Therefore, the basket 300 couples with the lower rack assembly 122 via the clip 350 receiving at least one of the transverse side rail 222 or the lateral side rail 224 of the lower rack assembly 122. Further, the clip 350 may allow for the basket 300 to abut the lower rack assembly 122 at either a transverse side rail 222 or a lateral side rail 224. Additionally, or alternatively, the basket 300 may abut both the lateral side rail 224 and the transverse side rail 222.

With even further reference to FIGS. 3 through 8, the basket 300 includes a shell 306. The shell 306 may define a grid, as illustrated. The grid of the shell 306 allows for the basket 300 to release liquid and dry faster after the dishwasher 100 has completed an operating cycle. Further, the grid allows liquid to contact the utensils for cleaning purposes during the operating cycle. The grid may take the form as rectangles, as illustrated. Alternatively, the grid may take the form of another conceivable shape (e.g., circles).

As shown, the shell 306 of the basket 300 generally extends along the vertical direction V between a top wall 310 and a bottom section 318 (not shown). Further, the shell 306 extends in the lateral direction L and the transverse direction T along a sidewall 312. As will be described in detail below, the basket 300, and therefore the shell 306, may be generally formed as a single, integral, unitary component, advantageously requiring no post-molding or post-formation processing (e.g., attachment of multiple parts, coating, or polishing). In particular, a handle 340 may be formed as an integral unitary component with the shell 306 and may extend upward therefrom (e.g., at the top wall 310, as illustrated in the exemplary embodiment).

The sidewall 312, as illustrated in the exemplary embodiment, includes at least one transverse sidewall 314 coupled with the top wall 310 and the bottom wall 318 while extending therebetween. Further, the sidewall 312 may include at least one lateral sidewall 316, as illustrated. Therefore, the shell 306 may be generally rectangular, oblong, and prismatic, as illustrated. Alternatively, the shell 306 may be at least one of curved, continuous, or equidistant from a geometric center. Further, the basket 300 may define a main opening 320 specifically defined by the top wall 310 and the sidewall 312 including the transverse sidewall 314 and the lateral sidewall 316.

The basket 300 includes an article locator 322 coupled with the shell 306. Additionally, or alternatively, the article locator 322 may be integrally formed with the shell 306. In other words, the article locator 322 and the shell 306 may be unitarily formed. As illustrated, the article locator 322 may be positioned at the bottom wall 318 of the shell 306. Additionally, or alternatively, the article locator 322 may be positioned at the top wall 310 the lateral side wall 316 or the transverse sidewall 314. Further, the article locator 322 may be positioned toward the transverse sidewall 314. Additionally, or alternatively, the article locator 322 may be positioned toward a lateral side wall 316. The article locator 322 may be positioned vertically under the main opening 320.

The article locator 322 may include a cone 326. As illustrated, the cone 326 may narrow as the cone extends downward. Additionally, or alternatively, the cone 326 may narrow as the cone 326 extends upward. Therefore, the cone 326 may receive the article 308, as illustrated. Additionally, or alternatively, the article 308 may be configured to receive the cone 326. The article locator 322 defines an aperture 324 aligned with the grid of the shell 306. The locator is configured to align with an article 308. Additionally, or alternatively, the article 308 may specifically be a straw 336. Therefore, the aperture 324 may be centrally located on the cone 326 such that the straw 336 is centrally aligned with the article locator 322 and fluid is directed through the straw 336.

With reference to FIGS. 4 through 8, the basket 300 includes at least one rib 328 coupled with the shell 306. Additionally, or alternatively, the at least one rib 328 may be unitarily formed with the shell 306. As illustrated, the at least one rib 328 extends downwardly from the shell 306. Specifically, the at least one rib 328 extends downwardly from the bottom wall 318.

The at least one rib 328 may comprise a transverse rib 330 that extends transversely across the bottom wall 318. Additionally, or alternatively, the at least one rib 328 may also comprise a lateral rib 332 that extends laterally across the bottom wall 318. Each rib 328 may define a recess 334. The recess 334 may be configured to receive the manifold 200, as illustrated in FIG. 6. The recess 334 defined by the lateral rib 332 allows for the basket 300 to be stabilized in the transverse direction T relative to the manifold 200. Further the recess 334 defined by the transverse rib 330 allows for the basket 300 to be stabilized in the lateral direction L relative to the manifold 200. Therefore, the recess 334 of the rib 300 28 may be generally referred to as a manifold locator.

Figure 5:
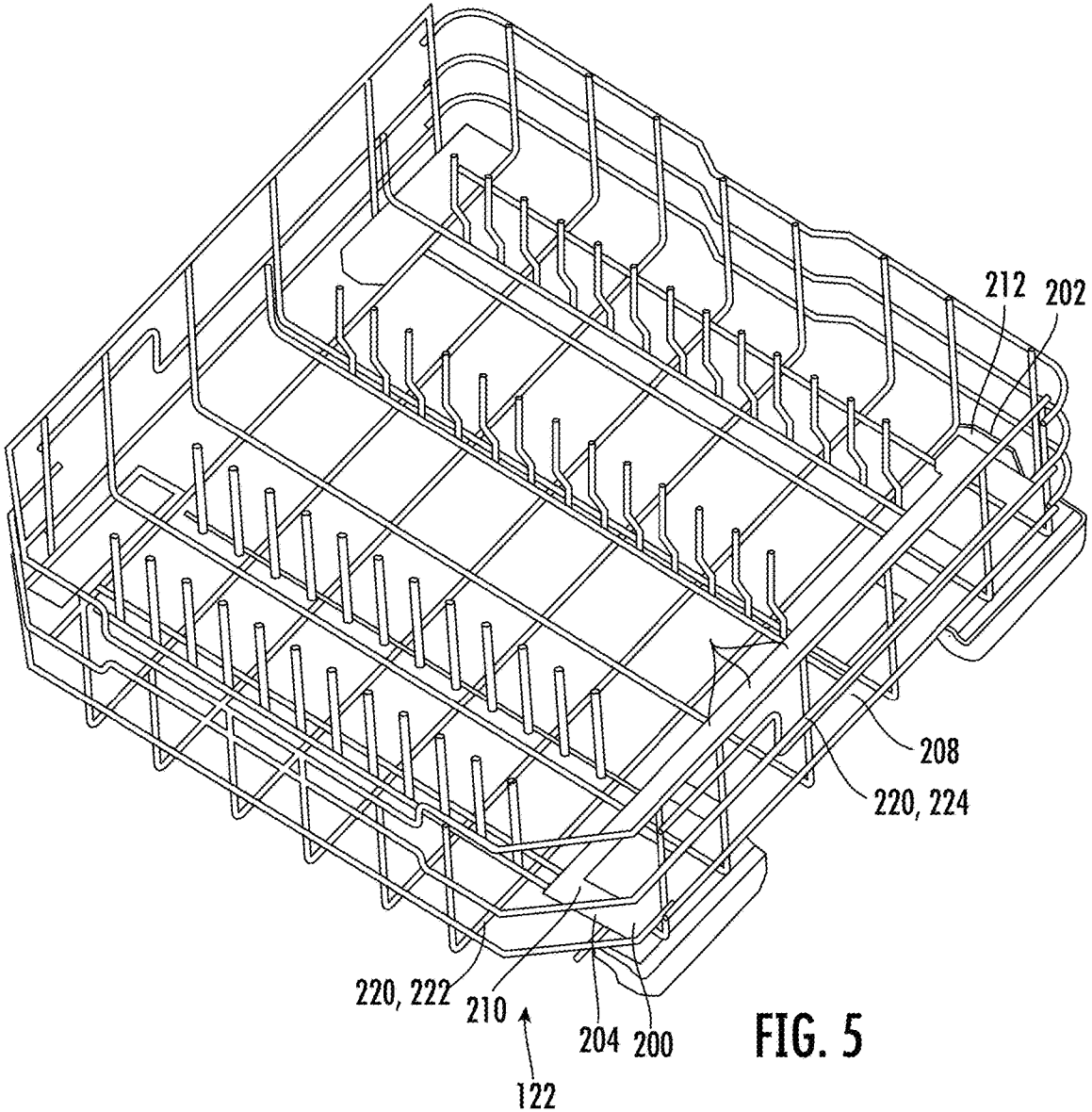
FIG. 5 provides a top perspective view of a lower rack of the exemplary dishwashing appliance of FIG. 1 according to an example embodiment of the present subject matter.

With specific reference to FIG. 5, the manifold 200 includes a rear end 202 that defines an inlet 212 operatively, fluidly coupled with the primary supply conduit 154 (shown in FIG. 2). The manifold further includes a front end 204 distal the rear end 202. The manifold 200 may include a transverse conduit 208 extent in the transverse direction T. Additionally, or alternatively, the manifold 200 may include a lateral conduit 210 that extends along the lateral direction L. The manifold 200 defines at least one port 206. Additionally, or alternatively, at least one of the transverse conduit 208 or the lateral conduit 210 may define the at least one port 206. As illustrated, the manifold 200 rests atop the lower rack assembly 122. Additionally, or alternatively, the manifold 200 may be located vertically underneath the lower rack assembly 122.

With reference to FIGS. 7 through 8, the basket 300 couples with the lower rack assembly via the clip 350 receiving the lower rack side rail 220, which may include the transverse side rail 222 and/or the lateral side rail 224. Further, the basket 300 rests atop the manifold 200. The basket 300 is stabilized relative to the manifold 200 via the recess 334 of the rib 328 extending from the bottom wall 318 of the shell 306. The recess 334 of the rib 328 may also allow the port 206 of the manifold 200 to be aligned with the grid of the shell 306. Additionally, or alternatively, the recess 334 of the rib 328 allows for the aperture 324 of the article locator 322 to be aligned with the port 206. Specifically, the recess 334 of the at least one transverse rib 330 allows for the aperture 324 of the article locator 322 to be aligned with the port 206 along the lateral direction L. Further, the recess 334 of the at least one lateral rib 332 allows for the aperture 324 of the article locator 322 to be aligned with the port 206 along the transverse direction T.

As illustrated, the article locator 322 may abut against the manifold 200 such that the port 206 is fluidly coupled with the aperture 324 to direct fluids therebetween without substantial leakage. Additionally, or alternatively, the port 206 may be aligned with the aperture 324 and spaced therefrom.

The top wall 310 of the shell 306 of the basket 300 may include a retention feature 338 configured to couple with the article 308, for example the straw 336. The retention feature 338 may be vertically aligned with the article locator 322 such that the article 308 is held vertically upright. In other words, the retention feature 338 may be plumb with the article locator 322. The retention feature 338 may be generally arcuate such that there can be a friction fit with the straw 336.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A dishwashing appliance defining a vertical, a lateral, and a transverse direction, the dishwashing appliance comprising:

a wash tub that defines a wash chamber for receipt of an article for washing;

a manifold disposed within the wash chamber, the manifold defining at least one port; and a basket operably positioned within the wash chamber, wherein the basket comprises:

an article locator defining an aperture aligned with the at least one port; wherein the article locator aligns with the article to direct fluid from the manifold to the article; and a manifold locator that operably engages the manifold, the manifold locator comprising:

at least one lateral rib, wherein the recess of the at least one lateral rib stabilizes the basket transversely relative to the manifold to align the article locator with the at least one port of the manifold along a transverse direction; and at least one transverse rib, wherein the recess of the at least one transverse rib stabilizes the basket laterally relative to the manifold to align the article locator with the at least one port of the manifold along a lateral direction.

2. The dishwashing appliance of claim 1, wherein the article comprises a straw, and wherein the locator directs fluid through the straw.

3. The dishwashing appliance of claim 1, wherein the basket operably rests atop the manifold.

4. The dishwashing appliance of claim 1, wherein the article locator comprises a cone.

5. The dishwashing appliance of claim 4, wherein the cone is configured to receive the article.

6. The dishwashing appliance of claim 1, wherein the basket further comprises a top wall comprising at least one retention feature.

7. The dishwashing appliance of claim 6, wherein the at least one retention feature is plumb with the article locator such that the article aligned with the article locator and coupled with the retention feature remains upright.

8. The dishwashing appliance of claim 1, wherein the article locator abuts against the manifold at the at least one port.

9. The dishwashing appliance of claim 1, further comprising a rack slidable between an extended position and a retracted position, wherein the manifold is coupled with the rack.

10. The dishwashing appliance of claim 9, wherein the basket further comprises a clip, and wherein the clip is operably coupled with the rack.

11. The dishwashing appliance of claim 10, wherein the basket operably abuts against the rack in a lateral direction and a transverse direction to align the article locator with the at least one port of the manifold.

12. A basket for supporting articles within a wash chamber of a dishwashing appliance, the dishwashing appliance comprising a manifold, the basket comprising:

a shell for operably engaging with the manifold within the wash chamber;

an article locator coupled with the shell, wherein the article locator is for aligning with a port defined by the manifold such that fluid directed through the manifold is directed through the article locator to an article aligned with the article locator;

a manifold locator that operably engages the manifold, the manifold locator comprising:

at least one lateral rib, wherein a recess of the at least one lateral rib stabilizes the basket transversely relative to the manifold to align the article locator with the at least one port of the manifold along a transverse direction; and at least one transverse rib, wherein a recess of the at least one transverse rib stabilizes the basket laterally relative to the manifold to align the article locator with the at least one port of the manifold along a lateral direction; and a clip for operably coupling with the rack of the dishwashing appliance.

13. The basket of claim 12, wherein the article comprises a straw, and wherein the fluid flows through the straw.

14. The basket of claim 12, wherein the shell comprises a bottom wall such that the basket rests atop the manifold.

15. The basket of claim 12, wherein the rack of the dishwashing appliance translates relative to the wash chamber, wherein the manifold is coupled with the rack such that the basket operably translates with the manifold and the rack.

16. The basket of claim 12, wherein the basket further comprises a top wall comprising a retention feature operably coupled with the article.

17. A dishwashing appliance defining a vertical, a lateral, and a transverse direction, the dishwashing appliance comprising:

a wash tub that defines a wash chamber for receipt of an article for washing;

a manifold disposed within the wash chamber, the manifold defining at least one port; and a basket operably positioned within the wash chamber, wherein the basket comprises:

an article locator defining an aperture aligned with the at least one port; wherein the article locator is configured to receive the article therein to direct fluid from the manifold to the article; and a manifold locator that operably engages the manifold, the manifold locator comprising:

at least one lateral rib, wherein the recess of the at least one lateral rib stabilizes the basket transversely relative to the manifold to align the article locator with the at least one port of the manifold along a transverse direction; and at least one transverse rib, wherein the recess of the at least one transverse rib stabilizes the basket laterally relative to the manifold to align the article locator with the at least one port of the manifold along a lateral direction.

18. The dishwashing appliance of claim 17, further comprising a door pivotable between an open position and a closed position relative to the wash tub, wherein the door in the closed position further defines the wash chamber, and wherein the basket is configured to be encapsulated by the wash chamber defined by the door and the wash tub.

* * * * *